US008784043B2

(12) United States Patent
Bouru

(10) Patent No.: US 8,784,043 B2
(45) Date of Patent: Jul. 22, 2014

(54) DEVICE FOR CONTROLLING VARIABLE-PITCH BLADES IN A TURBOMACHINE COMPRESSOR

(75) Inventor: Michel Andre Bouru, Montereau sur le Jard (FR)

(73) Assignee: SNECMA, Paris (FR)

( * ) Notice: Subject to any disclaimer, the term of this patent is extended or adjusted under 35 U.S.C. 154(b) by 916 days.

(21) Appl. No.: 12/937,137

(22) PCT Filed: Apr. 10, 2009

(86) PCT No.: PCT/FR2009/000418

§ 371 (c)(1),
(2), (4) Date: Oct. 8, 2010

(87) PCT Pub. No.: WO2009/133297

PCT Pub. Date: Nov. 5, 2009

(65) Prior Publication Data

US 2011/0033297 A1 Feb. 10, 2011

(30) Foreign Application Priority Data

Apr. 24, 2008 (FR) ..... 08 02289

(51) Int. Cl.
*F01D 17/16* (2006.01)

(52) U.S. Cl.
USPC ..... 415/160; 92/128

(58) Field of Classification Search
USPC ..... 415/148, 151, 155, 159, 160, 162; 92/161, 128
See application file for complete search history.

(56) References Cited

U.S. PATENT DOCUMENTS

| | | | | |
|---|---|---|---|---|
| 3,487,992 | A * | 1/1970 | Pineda | 415/149.4 |
| 3,779,665 | A * | 12/1973 | Tatem et al. | 415/123 |
| 3,873,230 | A | 3/1975 | Norris et al. | |
| 4,295,784 | A | 10/1981 | Manning | |
| 4,720,237 | A | 1/1988 | Weiner et al. | |

FOREIGN PATENT DOCUMENTS

| | | |
|---|---|---|
| CA | 1 015 277 | 8/1977 |
| EP | 0 235 073 | 9/1987 |

OTHER PUBLICATIONS

International Search Report issued Sep. 14, 2009 in PCT/FR09/00418 filed Apr. 10, 2009.

* cited by examiner

*Primary Examiner* — Edward Look
*Assistant Examiner* — Jason Davis
(74) *Attorney, Agent, or Firm* — Oblon, Spivak, McClelland, Maier & Neustadt, L.L.P.

(57) ABSTRACT

A device for controlling variable-pitch blades in a turbomachine compressor, including at least one control ring surrounding an external casing of the compressor, and a control shaft connected to the ring and to the rod of an actuator, the body of which is mounted such that it can pivot about an axle borne by a support mechanism of the control shaft so as to guarantee a precise relative positioning of the axis of pivoting of the actuator with respect to the control shaft.

18 Claims, 5 Drawing Sheets

DEVICE FOR CONTROLLING VARIABLE-PITCH BLADES IN A TURBOMACHINE COMPRESSOR

BACKGROUND

The present invention relates to a device for controlling variable-pitch blades in a turbomachine such as an aircraft turbojet or turboprop.

A turbomachine of this type comprises one or a plurality of variable-pitch guide blade stages which are mounted between the wheels of a compressor. These variable-pitch blades are carried by the turbomachine stator and are adjustable in position about the axes thereof to optimise gas flow in the turbomachine engine.

Each variable-pitch blade comprises a cylindrical pivot at each of the ends thereof, said pivots defining the axis of rotation of the blade. The radially external pivot is engaged in a cylindrical duct of an external annular casing of the turbomachine and is connected by a connecting rod to a ring which is mounted about the casing and is in turn connected by a lever to a control shaft actuated by a cylinder. The control shaft runs parallel to the casing axis and may be connected to one or a plurality of the abovementioned rings to control one or a plurality of guide blade stages.

The cylinder rod is connected to the control shaft by a radial arm rigidly connected to the control shaft. The linear movement of the cylinder rod causes the control shaft to rotate about the axis thereof and the or each ring to be driven in rotation about the casing. The rotation of a drive ring is transferred by the corresponding connecting rods to the external pivots of the blades of one stage and rotates same about the axes thereof.

DESRCRIPTION OF THE RELATED ART

In the prior art, the cylinder is pivotably mounted about an axis parallel with the casing axis, said axis being carried by means, such as a cap, fixed on the casing independently from the support and rotational guidance means of the control shaft. The cylinder pivoting axis is generally in the vicinity of the end of the cylinder, next to the side opposite the movable rod thereof (see for example document U.S. Pat. No. 3,779,665).

This type of control device is the subject of recurrent maintenance operations during which the various parts of this device are disassembled and removed from the casing, and refitted on the casing. The production and assembly tolerances of these parts mean that the relative positioning of the cylinder and the control shaft is subject to variation, conveyed by a loss of precision in the variable-pitch blade control. For example, differences in the relative position of the cylinder and the control shaft in the region of approximately several tenths of a millimetre have been observed, which may give rise to imprecision in the angular pitch of the guide blades in the region of several tenths of a degree.

BRIEF SUMMARY

The aim of the invention is specifically that of avoiding this drawback simply, effectively and economically.

For this purpose, it relates to a device for controlling variable-pitch blades in a turbomachine compressor, comprising a control ring rotatably mounted about an external casing of the compressor and to be connected by means such as connecting rods to variable-pitch blades, and a cylinder wherein the body can pivot about a fixed axis and wherein the movable rod is connected to the control shaft by connecting rod means carried by a control shaft guided in rotation by supporting members attached to the casing, characterised in that the pivoting axis of the cylinder body is carried by the control shaft supporting members and by at least one tab attached on the casing.

The invention makes it possible to define a precise mounting position of the cylinder pivoting axis in relation to the control shaft and locate this relative position after maintenance disassembly and reassembly operations, while retaining the parallelism between the pivoting axis of the cylinder and the control shaft, regardless of the manufacturing and assembly tolerances of the parts of the control device.

In one embodiment of the invention, the cylinder body comprises a first cylindrical radial blade foot guided in rotation in an orifice of a tab rigidly connected to one of the supporting members of the control shaft, and a second cylindrical radial blade foot, diametrically opposite said first blade foot, and guided in rotation in an orifice of a second tab attached on the casing. Said second tab is independent from the supporting members of the control shaft.

The second blade foot is advantageously engaged in an eccentric guide ring housed in the orifice of the second tab to compensate for any misalignment between the orifices of the two attachment tabs. Two radially grooved washers are preferably engaged on the eccentric ring and inserted between the second tab and an external annular rim of the ring, one of the washers being rigidly connected in rotation with the tab and comprising radial grooves engaging with complementary radial grooves of the other washer which is locked in rotation on the ring. The washers may be clamped axially between the tab and the annular rim of the ring by an insert attached to the tab and pressing axially on the annular rim of the ring, on the side opposite the tab.

In one alternative embodiment, the cylinder body comprises two diametrically opposed radial blade feet defining the pivoting axis of the cylinder body and received in orifices or notches of two tabs of a supporting clamp attached on the casing, each blade foot being further connected by a connecting rod to the control shaft. The clamp and the tabs thereof are independent from the supporting members of the control shaft. Each connecting rod connecting a blade foot to the control shaft may comprise at one end an orifice wherein the blade foot is guided in rotation and at the opposite end thereof an orifice whereby the connecting rod is rotatably mounted on the control shaft.

The or each blade foot is preferably integral with the cylinder body, for example by means of foundry.

The control shaft is for example supported and guided in rotation by V-shaped supporting members attached to annular flanges of the casing.

The control shaft is preferentially connected to the cylinder rod and to the control ring by radial arms with which it is rotatably rigidly connected. It may be connected by two radial arms, with which it is rotatably rigidly connected, to two parallel control rings, for the control of two annular rows of variable-pitch blades. The device may control a greater number of annular rows of variable-pitch blades, for example four. The control shaft is then connected by four radial arms to four control rings of the abovementioned type.

The pivoting axis of the cylinder may be situated substantially mid-way from the ends of the cylinder body and in the vicinity of the end of the cylinder body, situated on the side of the movable rod of said cylinder.

The invention also relates to a turbomachine compressor, comprising at least one device for controlling variable-pitch blades as described above, as a turbomachine, such as an aircraft turbojet or turboprop, comprising at least one such device.

BRIEF DESCRIPTION OF THE DRAWINGS

The invention will be understood more clearly and other features, details and advantages of the invention will emerge more clearly on reading the following description provided as a non-limitative example and with reference to the appended figures, wherein.

DETAILED DESCRIPTION

Figure 1:
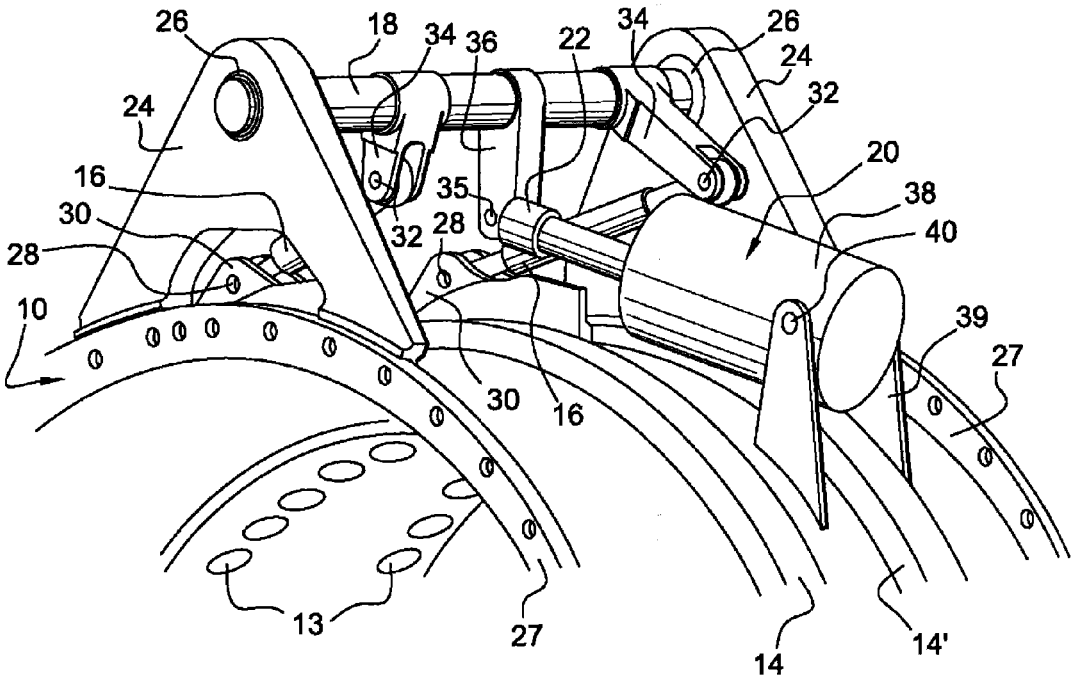
Fig. 1 Prior Art
FIGS. 1 and 2 are partial perspective schematic views of devices for controlling variable-pitch blades according to the prior art relative to the present invention, FIGS. 3 and 4 and partial perspective schematic views of a control device according to the invention.
Figure 2:
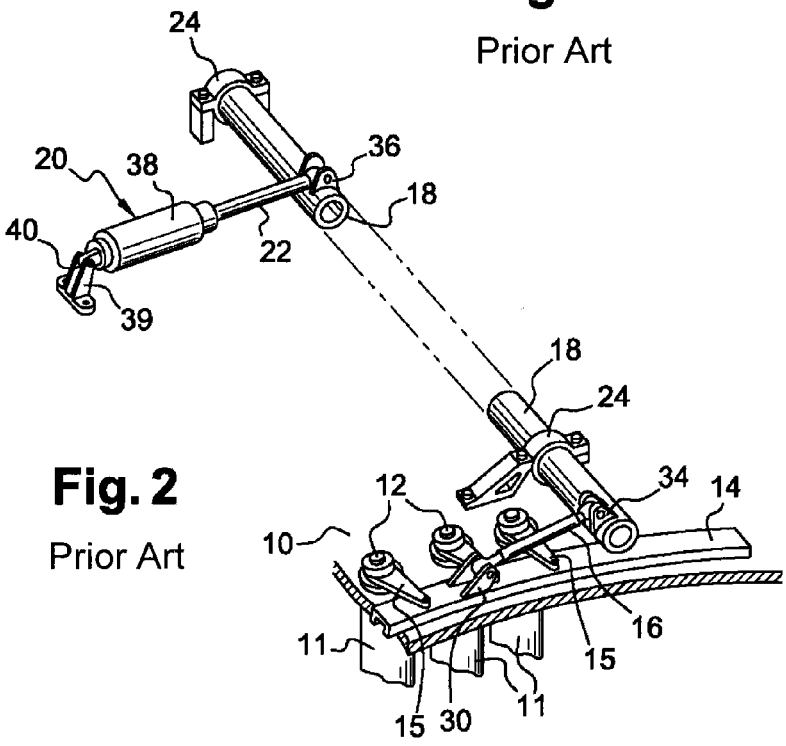
Fig. 2 Prior Art

The devices for controlling variable-pitch blades represented in FIGS. 1 and 2 are each mounted on a substantially cylindrical external casing 10 of a turbomachine compressor such as an aircraft turbojet or turboprop.

The casing 10 bears one or a plurality of variable-pitch blade stages, one of which is partially represented in FIG. 2. The blades 11 of a stage are evenly distributed about the axis of revolution of the casing 10, and each comprise a vane connected at the radially external end thereof to a radial cylindrical pivot 12 running along the axis of rotation of the blade and which is engaged in a cylindrical duct 13 of the casing. The radially external end of said pivot is connected to one end of a connecting rod 15 wherein the other end is connected to a control ring 14, 14'.

The control device may comprise one or a plurality of rings 14, 14'. It comprises two thereof in the example in FIG. 1 and only one in the case of FIG. 2. Each ring 14, 14' encompasses the casing 10 and is connected by a lever 16 to a control shaft 18 running substantially parallel with the axis of revolution of the casing. The control shaft 18 is further connected to the movable shaft 22 of a hydraulic, pneumatic or electric cylinder 20.

The control shaft 18 is carried at the ends thereof by two supporting members 24 attached on the casing 10. Each supporting member 24 in FIG. 1 comprises a cylindrical housing wherein a bearing 26 for centring and guiding one end of the shaft 18 is received. The members in this case are substantially V-shaped and each comprise two jambs applied and attached, for example using screw-nut means, at the radially internal free ends thereof onto the casing 10. The housings for receiving the bearings 26 are situated at the junction between the two jambs of the members 24. The control shaft 18 runs, in the case of FIG. 1, along the entire axial dimension of the casing 10, and the supporting members 24 are attached on annular flanges 27 provided at the axial ends of the casing.

Each lever 16 is hinged at a first end on an axis 28 carried by a cap 30 of the corresponding ring 14, 14'. The second end of the lever 16 is hinged on an axis 32 carried by a radial arm 34 rotatably rigidly connected to the control shaft 18. The movable rod 22 is further hinged on an axis 35 carried by a further radial arm 36 rotatably rigidly connected to the control shaft 18. The axes 28, 32 and 35 are parallel with each other and the casing axis.

The radial arms 34 and 36 are angularly offset in relation to the others about the axis of the control shaft 18. The radial arms 34, 36 and the levers 16 have given lengths. These various parameters (angular offset between the arms and lengths of the arms and levers) are predetermined such that a linear movement of the movable rod 22 of the cylinder 20 causes, by rotating the control shaft 18, a given angular movement of each ring 14, 14' about the casing axis, and is conveyed by the rotation of the corresponding variable-pitch blades 11 about the axes thereof.

In the prior art, the body 38 of the cylinder 20 is pivotably mounted on supporting means 39 attached on the casing 10, about an axis 40 parallel with the casing axis. These supporting means 39 are independent from the control shaft 18 and the supporting members 24 of said shaft. The pivoting axis 40 is situated in the vicinity of the end of the cylinder 20, situated on the side opposite the movable rod 22 thereof.

The manufacturing and assembly tolerances of the various parts of the control device, and particularly those of the cylinder 20 and the means 39 for attaching the cylinder 20 on the casing 10, mean that the relative positions of the various parts are not sufficiently precise, and are not reproducible after each disassembly/reassembly cycle. This is conveyed by imprecision in the angular offset of the blades 11 which may impair the performances of the compressor and the turbomachine.

The present invention makes it possible to solve this problem using the means for supporting the control shaft which are connected to the pivoting axis of the cylinder so as to define a precise mounting position of said pivoting axis in relation to the control shaft.

Figure 3:
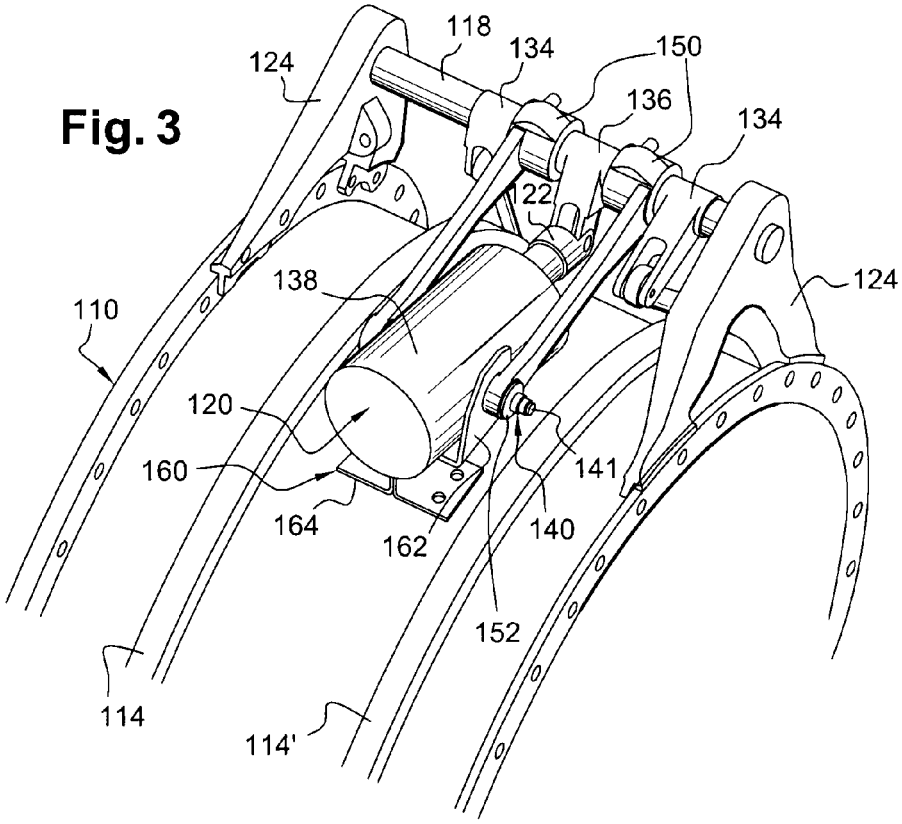
Figure 4:
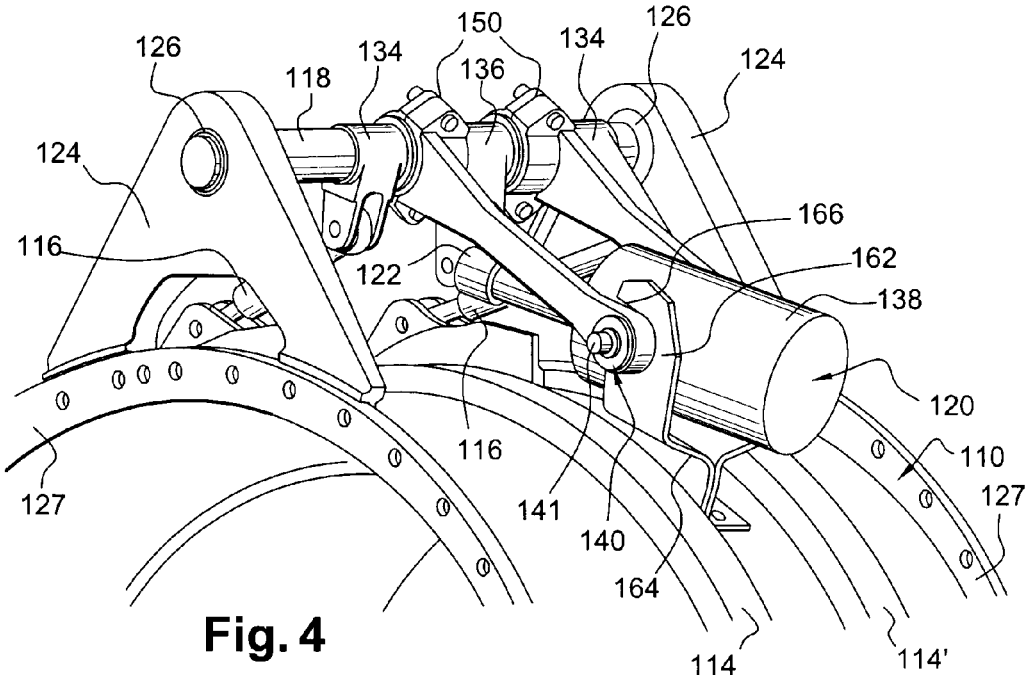

Reference will now be made to FIGS. 3 and 4 wherein the members already described with reference to FIGS. 1 and 2 are designated with the same figures increased by one hundred.

In the embodiment of the invention represented in FIGS. 3 and 4, the pivoting axis 140 of the cylinder 120 is connected to the supporting members 124 via the control shaft 118 and two connecting rods 150 running along either side of the cylinder 120, between the pivoting axis 140 and the control shaft 118. The axis 140 and the shaft 118 are parallel with each other.

The pivoting axis 140 is situated substantially mid-way from the ends of the cylinder body. In this instance, it is defined by two diametrically opposed cylindrical radial blade feet 141 in relation to the cylinder axis and running along either side of the cylinder body 138. Each blade foot 141 is integral with the cylinder body 138, and comprises one free end which is centred and guided in rotation in an orifice of a first end of a connecting rod 150. The second end of each connecting rod 150 comprises an orifice traversed by the control shaft 118.

Bearings 152 are mounted in the orifices of the connecting rods 150 for centring and guiding the shaft 18 and the axis 140 in rotation. The connecting rods 150 are mounted rotating freely on the control shaft 118 and on the pivoting axis 140, and are not rotated about the axis of the shaft 118 during the rotation of said shaft. Each connecting rod 150 extends in this instance between the radial arm 136 connected to the cylinder 120 rod and a radial arm 134 connected to the lever 116 of a ring 114, 114'.

The pivoting axis 140 is further supported by a supporting clamp 160 attached on the casing 110. This clamp 160 is substantially U-shaped and comprises two parallel tabs 162 connected to each other by a median portion 164 attached to the casing 110 by screw-nut type means. The tabs 162 of the clamp extend on either side of the cylinder 120 body and comprise orifices or notches 166 for receiving the blade feet 141 defining the pivoting axis 140. The notch 166 of each tab is, in this instance, substantially U- or C-shaped and opens onto one side of the tab 162, situated on the side of the cylinder rod 122.

The control device functions as follows. The cylinder 120 is powered to move the rod 122 thereof in a linear fashion over a predetermined axial stroke. The movement of the cylinder rod is converted into a rotation of the control shaft 118 about the axis thereof and a rotation of the rings 114, 114' about the casing axis. The movement of the rod 122 also causes slight pivoting of the cylinder 120 about the axis 140, said axis being rotationally guided in the orifices of the rotatably mounted connecting rods 150 on the control shaft.

During a cylinder 120 maintenance operation, requiring the disassembly of the cylinder and the refitting thereof on the casing 110, the relative position of the pivoting axis 140 of the cylinder in relation to the control shaft 118 is preserved.

Reference is now made to FIGS. 5 to 8 wherein the items already described with reference to FIGS. 1 and 2 are designated using the same figures increased by two hundreds.

Figure 5:
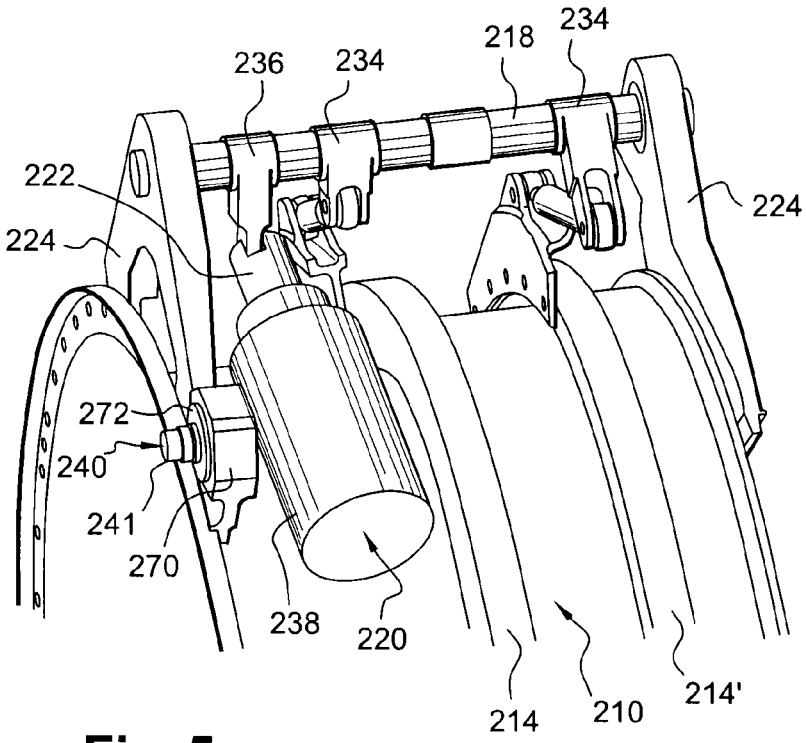
FIGS. 5 and 6 are partial perspective schematic views of a further control device.
Figure 6:
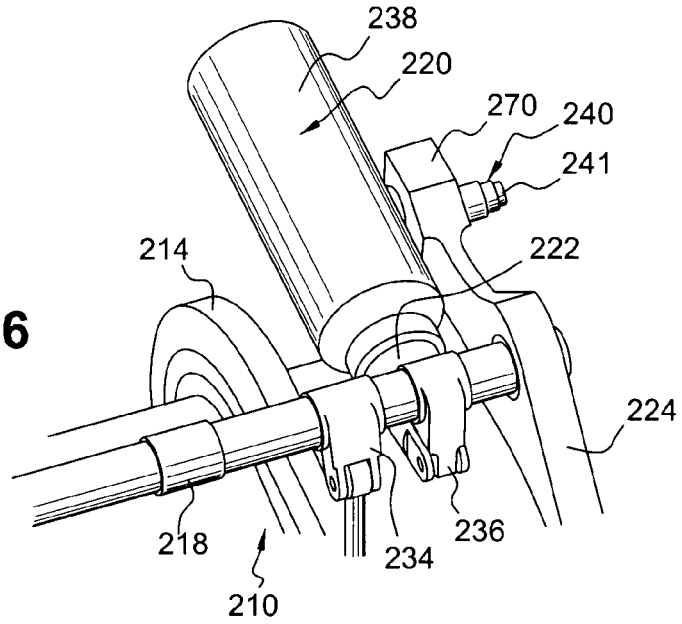

In the control device in FIGS. 5 and 6, the pivoting axis 240 is carried directly by one of the supporting members 224 of the control shaft 218, the axis 240 and the shaft 218 being parallel with each other.

The cylinder 220 has, in this instance, been brought closer to a supporting member 224 wherein one of the jambs is rigidly connected to a cylinder support tab 270. The pivoting axis 240 is situated in the vicinity of the end of the cylinder, on the side of the movable rod 222 thereof, and only runs on one side of the cylinder. This axis 240 is defined by a cylindrical radial blade foot 241 wherein one end is engaged into an orifice of a radial cylindrical boss of the cylinder body, and wherein the other end is received in a bearing 272 mounted in a corresponding cylindrical housing of the tab 270.

Figure 7:
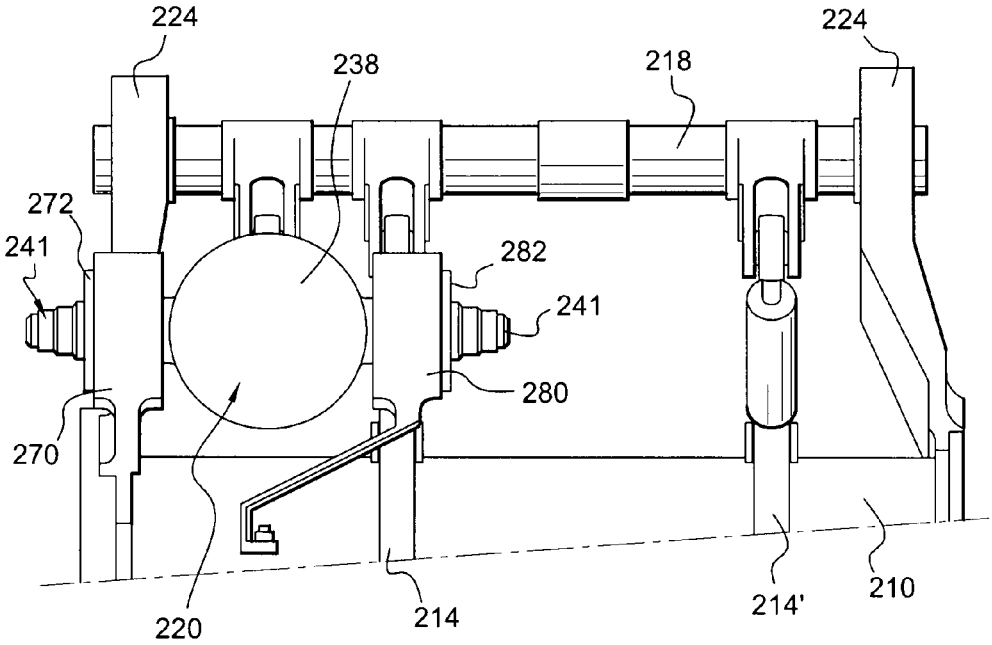
FIG. 7 is a partial perspective schematic view of an alternative embodiment of the device according to the invention.
Figure 8:
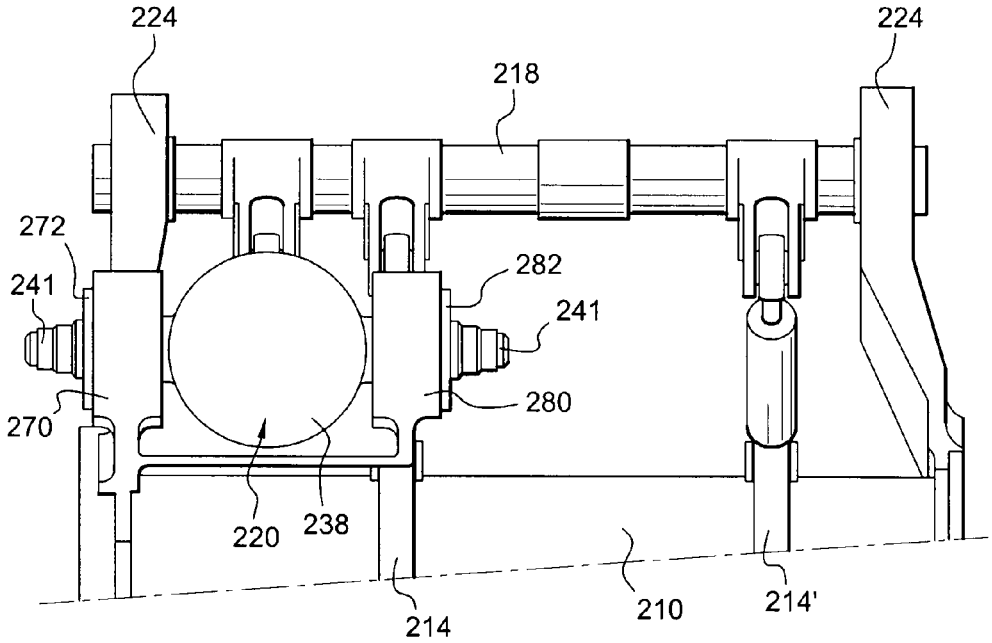
FIG. 8 is a view corresponding to FIG. 7 and represents a further control device.

FIG. 7 represents an alternative embodiment of the control device according to the invention. FIG. 8 represents a further control device. In both cases, the devices differ from the embodiment in FIGS. 5 and 6, particularly in that a second cylindrical radial blade foot 241 is diametrically opposite the first blade foot 241, in relation to the cylinder axis, such that the cylinder pivoting axis 240 runs on either side of the cylinder body 238. Said second blade foot 241 is also integral with the cylinder body, and comprises a free end received in a bearing 282 carried by a further tab 280 running parallel with the first tab 270.

In the example in FIG. 7, the second tab 280 is attached onto the casing 210 by screw-nut type means. In the case of FIG. 8, this tab 280 is connected to the tab 270 of the member 224 and forms a U-shaped clamp therewith.

In both cases mentioned above, the bearings for centring and guiding the blade feet 141, 241 of the cylinder are locked axially in the orifices of the support tabs 270, 280 or the ends of the connecting rods 150 by nuts screwed onto the threaded portions of the blade feet.

Figure 9:
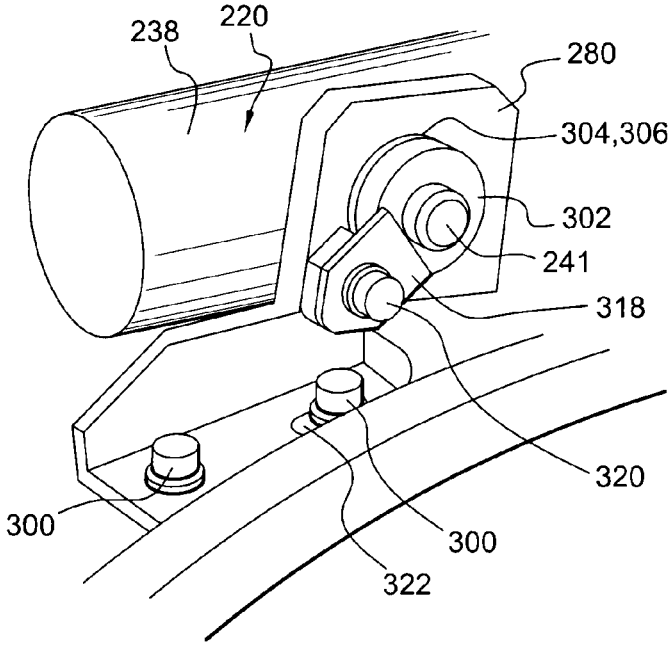
FIG. 9 is a partial perspective schematic view of a further alternative embodiment of the device according to the invention.

The alternative embodiment represented in FIG. 9 differs from that in FIG. 7 essentially by the system for centring and guiding the blade foot 241 in the orifice of the second tab 280 and by the means for locking said system axially in said orifice.

The manufacturing and assembly tolerances may give rise, after the attachment of the second tab 280 by screws 300 or similar on the casing 210, to a misalignment between the orifices of the tabs 270, 280 for housing the blade feet 241. To remedy this drawback, the system for centring and guiding the blade foot 241 engaged in the orifice of the second tab 280 particularly comprises an eccentric cylindrical ring 302 to compensate for said misalignment, said system being represented in FIG. 10. The eccentric ring 302 comprises an external cylindrical surface engaging with the internal cylindrical surface of the orifice of the tab 280, and an axial cylindrical bore wherein the internal surface engages with the external cylindrical surface of the blade foot 241. The internal and external surfaces of the ring are, for example, offset in relation to each other by approximately 0.5 millimetres. The ring 302 is intended to be rotated about the second blade foot 241, in the orifice of the second tab 280, until the axial bore thereof is aligned with the orifice of the first tab 270.

Two radially grooved washers 304, 306 are engaged on the ring 302 and inserted axially between one face of the second tab 280, situated on the side opposite the cylinder 220, and one external annular rim 308 of the ring 302 (FIGS. 9 to 12). These washers 304, 306 lock the ring 302 in rotation in the orifice of the second tab 280 once said ring is in the abovementioned position wherein the axial bore thereof is aligned with the orifice of the first tab 270.

A first washer 304 comprises a lateral face pressing on the abovementioned face of the second tab 280 and comprising protruding tappets 310 engaging with grooves (not shown) having a corresponding shape provided on the tab to rigidly connect the first washer 304 of the tab 280 in rotation. The other face of said first washer 304 comprises evenly distributed radial grooves 312 about the axis thereof, for example forty in number. These grooves 312 engage with radial grooves 312 having a complementary shape formed on one of the faces of the second washer 306 also comprising a tappet 314 or similar engaging with a notch 316 of the ring to rigidly connect the second washer 306 with the ring 302 in rotation. The notch 316 may be formed on the external cylindrical surface of the ring 302 and on the face of the external rim 308 of the ring situated on the side of the tab 280, or merely on said face of the rim 308 to avoid weakening the eccentric ring. In this case, the tappet 314 is replaced on the washer 304 by a similar tappet system to that of the washer 306.

Each groove 312 of the first washer 304 (or of the second washer) engages with the grooves of the second washer 306 (or the first washer) to define a given angular position of the ring 302 about the axis thereof. The greater the number of grooves of each washer, the greater the number of different angular positions of the ring in the orifice of the second tab, and the more precise the adjustment of the abovementioned alignment. The spacing between two angular positions of the ring is determined by the spacing between two successive grooves of each washer.

The centring and guiding ring 302 is, in this instance, locked axially in the orifice of the second tab 280 via an insert 318 mounted and attached on the tab, and not by a nut screwed onto the blade foot, as was the case in the previous embodiments.

The insert 318 comprises an end comprising an orifice for inserting a screw 320 fastened in a corresponding orifice of the second tab 280. The opposite end of the insert 318 pressing axially on the external rim 308 of the ring 302, on the side opposite the tab 280, to lock said ring axially and clamp the radially grooved washers 304, 306 against each other.

Figure 10:
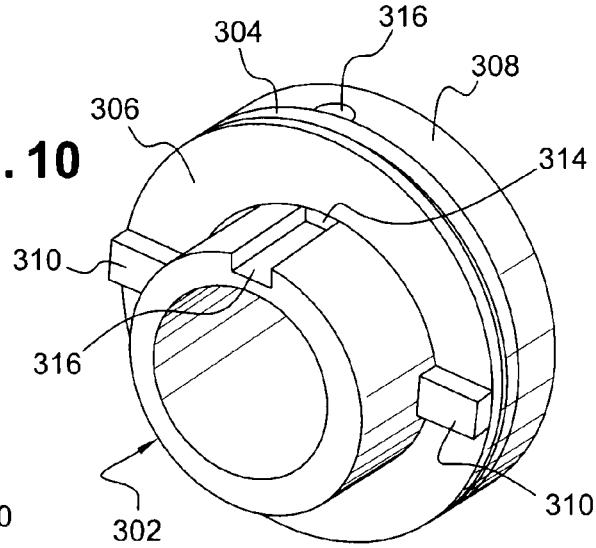
FIG. 10 is a perspective schematic view of the centring and guiding system in FIG. 9, FIGS. 11 and 12 are perspective and side schematic views of radially grooved washers of the system in FIG. 10, respectively.
Figure 11:
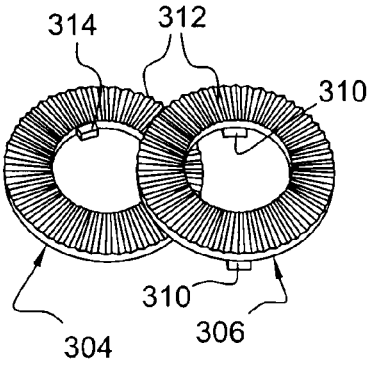
Figure 12:
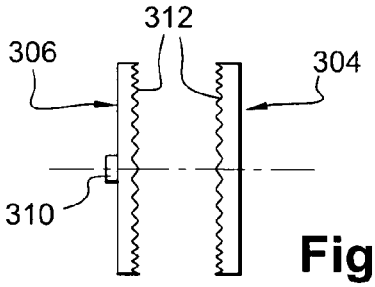

The second tab 280 of this embodiment is mounted and attached as follows after mounting and attaching the cylinder body on the first cylinder support tab 270. The second tab 280 is presented on the cylinder body, the second blade foot 241 of the cylinder 220 is engaged in the orifice of said tab and the system represented in FIG. 10 is engaged about the blade foot 241, in the orifice of the tab. The ring 302 is then rotated about the axis thereof, incrementally, until the end of the tab 280 rests on the casing 210. In this position, the tab 280 is positioned correctly on the casing 210 (the orifices or the slots 322 provided at the radially internal end of the tab 280 being aligned with corresponding orifices of the casing 210) and may be attached on the casing by the screws 300, and the orifice of said tab is centred on the pivoting axis of the cylinder defined by the first attachment tab 270 and by the two cylinder body blade feet 241.

The control devices according to the invention described and represented in FIGS. 3, 4 and 7 offer the advantage, in relation to the prior art, that the relative position of the pivoting axis of the cylinder and the control shaft axis, remains invariable after maintenance operation disassemblies and reassemblies, making it possible to retain variable-pitch blade control precision.

The blades controlled by the devices according to the invention may be of the type represented in FIG. 2, or any other type used in aircraft turbojets or turboprops.

The invention claimed is:

1. A device for controlling variable-pitch blades in a turbomachine compressor, comprising:

a control ring connected to a control shaft and rotatably mounted about an external casing of the compressor and to be connected by connecting rods to variable-pitch blades; and a cylinder, wherein a cylinder body can pivot about a fixed axis and wherein a movable rod is connected to the control shaft by connecting rod means carried by the control shaft guided in rotation by supporting members attached to the casing, wherein the pivoting axis of the cylinder body is carried by at least one tab attached on the casing, and wherein the cylinder body comprises a first cylindrical radial blade foot guided in rotation in an orifice of a first tab rigidly connected to one of the supporting members of the control shaft, and a second cylindrical radial blade foot, diametrically opposing said first blade foot, and guided in rotation in an orifice of a second tab which is attached to one of the casing and the first tab, with no pivotal support of the control shaft by the second tab.

2. A device according to claim 1, wherein each blade foot is integral with the cylinder body.

3. A device according to claim 1, wherein the control shaft is supported and guided in rotation by V-shaped supporting members attached to annular flanges of the casing.

4. A device according to claim 1, wherein the control shaft is connected to the cylinder and to the control ring by radial arms with which the control shaft is rotatably rigidly connected.

5. A device according to claim 4, wherein the control shaft is connected by two radial arms, with which the control shaft is rotatably rigidly connected, to two parallel control rings, for control of two annular rows of variable-pitch blades.

6. A device according to claim 1, wherein the pivoting axis of the cylinder is situated substantially mid-way from ends of the cylinder body or in a vicinity of one end of the cylinder body, situated on a side of the rod of the cylinder.

7. A turbomachine compressor, comprising at least one device for controlling variable-pitch blades according to claim 1.

8. A turbomachine, or an aircraft turbojet, or a turboprop, comprising at least one device for controlling variable-pitch blades according to claim 1.

9. A device according to claim 1, wherein the second blade foot is engaged in an eccentric guide ring housed in the orifice of the second tab to compensate for any misalignment between the orifices of the two attachment tabs.

10. A device according to claim 1, wherein each blade foot is integral with the cylinder body.

11. A device for controlling variable-pitch blades in a turbomachine compressor, comprising:

a control ring connected to a control shaft and rotatably mounted about an external casing of the compressor and to be connected by connecting rods to variable-pitch blades; and a cylinder, wherein a cylinder body can pivot about a fixed axis and wherein a movable rod is connected to the control shaft by connecting rod means carried by the control shaft guided in rotation by supporting members attached to the casing, wherein the pivoting axis of the cylinder body is carried by at least one tab attached on the casing, wherein the cylinder body comprises a first cylindrical radial blade foot guided in rotation in an orifice of a tab rigidly connected to one of the supporting members of the control shaft, and a second cylindrical radial blade foot, diametrically opposing the first blade foot, and guided in rotation in an orifice of a second tab attached on the casing, and wherein the second blade foot is engaged in an eccentric guide ring housed in the orifice of the second tab to compensate for any misalignment between the orifices of the two attachment tabs.

12. A device according to claim 11, wherein two radially grooved washers are engaged on the eccentric ring and inserted between the second tab and an external annular rim of the ring, one of the washers being rigidly connected in rotation with the tab and comprising radial grooves engaging with complementary radial grooves of the other washer which is locked in rotation on the ring.

13. A device according to claim 12, wherein the washers are clamped axially between the tab and the annular rim of the ring by an insert attached to the tab and pressing axially on the annular rim of the ring, on the side opposite the tab.

14. A device for controlling variable-pitch blades in a turbomachine compressor, comprising:

a control ring connected to a control shaft and rotatably mounted about an external casing of the compressor and to be connected by connecting rods to variable-pitch blades; and a cylinder, wherein a cylinder body can pivot about a fixed axis and wherein a movable rod is connected to the control shaft by connecting rod means carried by the control shaft guided in rotation by supporting members attached to the casing, wherein the pivoting axis of the cylinder body is carried by at least one tab attached on the casing, and wherein the cylinder body comprises two diametrically opposed radial blade feet defining the pivoting axis of the cylinder body and received in orifices or notches of two tabs of a supporting clamp attached on the casing, each blade foot being further connected by a connecting rod to the control shaft.

15. A device according to claim 14, wherein each connecting rod connecting a blade foot to the control shaft comprises at one end an orifice wherein the blade foot is guided in rotation and at the opposite end thereof an orifice whereby the connecting rod is rotatably mounted on the control shaft.

16. A device according to claim 14, wherein both connecting rods are situated between the supporting members.

17. A device according to claim 14, wherein the control shaft is connected to the movable rod and to the control ring by radial arms with which the control shaft is rotatably rigidly connected.

18. A device for controlling variable-pitch blades in a turbomachine compressor, comprising:

a control ring connected to a control shaft and rotatably mounted about an external casing of the compressor and to be connected by connecting rods to variable-pitch blades; and a cylinder, wherein a cylinder body can pivot about a fixed axis and wherein a movable rod is connected to the control shaft by connecting rod means carried by the control shaft guided in rotation by supporting members attached to the casing, wherein the pivoting axis of the cylinder body is carried by at least one tab attached on the casing, and wherein the cylinder body comprises one cylindrical radial blade foot only, guided in rotation in an orifice of a connecting tab rigidly connected to one of the supporting members of the control shaft which is V-shaped and is attached to the casing by ends of said V-shape.

* * * * *

UNITED STATES PATENT AND TRADEMARK OFFICE

CERTIFICATE OF CORRECTION

PATENT NO. : 8,784,043 B2
APPLICATION NO. : 12/937137
DATED : July 22, 2014
INVENTOR(S) : Michel Andre Bouru It is certified that error appears in the above-identified patent and that said Letters Patent is hereby corrected as shown below:

In the Specification

In column 3, line 61, after "members" insert --24--.

Signed and Sealed this
Second Day of June, 2015

Michelle K. Lee

Michelle K. Lee
*Director of the United States Patent and Trademark Office*